US008336324B2

(12) United States Patent
Ueda et al.

(10) Patent No.: US 8,336,324 B2
(45) Date of Patent: Dec. 25, 2012

(54) TURBO CHILLER AND CONTROL METHOD THEREFOR

(75) Inventors: Kenji Ueda, Aichi-ken (JP); Yoshinori Shirakata, Aichi-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 944 days.

(21) Appl. No.: 12/442,562

(22) PCT Filed: Nov. 9, 2007

(86) PCT No.: PCT/JP2007/071821

§ 371 (c)(1),
(2), (4) Date: Mar. 24, 2009

(87) PCT Pub. No.: WO2008/056782

PCT Pub. Date: May 15, 2008

(65) Prior Publication Data

US 2010/0024456 A1 Feb. 4, 2010

(30) Foreign Application Priority Data

Nov. 9, 2006 (JP) ..... 2006-303785

(51) Int. Cl.
*F25B 49/00* (2006.01)
*F25B 41/00* (2006.01)
*F01B 25/02* (2006.01)

(52) U.S. Cl. ..... 62/228.3; 62/228.1; 62/209; 415/162

(58) Field of Classification Search ..... 62/228.1, 62/228.3, 157, 208, 209; 415/162; 700/282
See application file for complete search history.

(56) References Cited

U.S. PATENT DOCUMENTS 4,770,602 A 9/1988 Miura et al.

FOREIGN PATENT DOCUMENTS

| | | | |
|---|---|---|---|
| JP | 59-138798 | A | 8/1984 |
| JP | 59-160097 | A | 9/1984 |
| JP | 60-8497 | A | 1/1985 |
| JP | 2003-307197 | A | 10/2003 |

OTHER PUBLICATIONS

International Search Report of PCT/JP2007/071821, Mailing Date of Dec. 25, 2007.

*Primary Examiner* — Chen Wen Jiang
(74) *Attorney, Agent, or Firm* — Westerman, Hattori, Daniels & Adrian, LLP

(57) ABSTRACT

A turbo chiller equipped with a high-efficiency two-stage turbo compressor is provided. In a turbo chiller including a control unit for controlling the degrees of opening of first inlet guide vanes of a first impeller and second inlet guide vanes of a second impeller, the control unit has a slave mode in which the second inlet guide vanes are operated so as to be dependent on the first inlet guide vanes in a slave-mode priority region, and an independent mode in which the degree of opening of the second inlet guide vanes is increased independently of the first inlet guide vanes in an independent-mode priority region.

4 Claims, 5 Drawing Sheets

TURBO CHILLER AND CONTROL METHOD THEREFOR

TECHNICAL FIELD

The present invention relates to a turbo chiller equipped with a turbo compressor for compressing a refrigerant in two stages and to a control method therefor.

BACKGROUND ART

Two-stage turbo compressors for compressing a refrigerant in two stages are frequently employed as turbo compressors used in refrigerant compressors of turbo chillers. A two-stage turbo compressor is equipped with a first impeller and a second impeller disposed downstream of this first impeller.

Such two-stage turbo compressors include turbo compressors equipped with first inlet guide vanes and second inlet guide vanes at respective refrigerant inlets of each impeller (see Patent Document 1). Generally, the degree of opening of the second inlet guide vanes is made dependent on the degree of opening of the first inlet guide vanes by a link mechanism or the like, so as to be equal to the degree of opening of the first inlet guide vanes, or greater.

Patent Document 1:

Japanese Unexamined Patent Application, Publication No. 2003-307197 (paragraph [0025] and FIG. 2)

DISCLOSURE OF INVENTION

Due to recent calls for energy saving, there is a demand for higher efficiency turbo compressors in order to improve the COP (coefficient of performance) of turbo chillers.

Examining two-stage turbo compressors from the viewpoint of efficiency, the existence of two cases has been noted: a case in which the efficiency is better when the degree of opening of the second inlet guide vanes is made dependent on the degree of opening of the first inlet guide vanes, and a case in which the efficiency is better when the degree of opening of the second inlet guide vanes is increased by controlling the degree of opening of the second inlet guide vanes independently of the first inlet guide vanes.

The present invention has been conceived in light of such circumstances, and an object thereof is to provide a turbo chiller equipped with a two-stage turbo compressor having high efficiency, as well as a control method therefor.

In order to solve the problems described above, the turbo chiller and control method therefor of the present invention employ the following solutions.

Specifically, a turbo chiller according to the present invention includes a turbo compressor, including a first impeller and a second impeller disposed downstream of the first impeller, for compressing a refrigerant in two stages; a condenser for condensing the refrigerant compressed by the turbo compressor; an expansion valve for expanding the refrigerant condensed by the condenser; and an evaporator for evaporating the refrigerant expanded by the expansion valve, wherein first inlet guide vanes and second inlet guide vanes for regulating gas flow rates by changing inflow angles of intake refrigerant to the impellers are provided at respective refrigerant intakes of the first impeller and the second impeller of the turbo chiller; and includes a control unit for controlling degrees of opening of the first inlet guide vanes and the second inlet guide vanes, wherein the control unit is provided with a slave mode in which the second inlet guide vanes are operated so as to be dependent on the first inlet guide vanes and an independent mode in which the degree of opening of the second inlet guide vanes is increased independently of the first inlet guide vanes.

As a result of close examination, in a turbo compressor for two-stage compression equipped with a first impeller and a second impeller, the inventors have discovered the existence of an operating region in which the efficiency is better in a slave mode in which the second inlet guide vanes are operated so as to be dependent on the first inlet guide vanes, compared with an independent mode in which the degree of opening of the second inlet guide vanes is increased independently of the first inlet guide vanes, and on the other hand, the existence of an operating region in which the efficiency is better in the independent mode than in the slave mode. Thus, by selectively using the slave mode and the independent mode with the control unit, it is possible to select the operation with better efficiency over a wide operating range.

In the case of the slave mode, the degree of opening of the second inlet guide vanes is preferably set to be the same as the degree of opening of the first inlet guide vanes, or greater.

In the case of the independent mode, it is preferable to control the degree of opening of the second inlet guide vanes so as to be larger than the degree of opening of the second inlet guide vanes in the slave mode, and further, to increase the degree of opening of the second inlet guide vanes to the extent that the second inlet guide vanes are nullified so as to regulate the refrigerant intake amount with the first impeller alone.

Furthermore, with the turbo chiller according to the present invention, the control unit may calculate a first parameter, defined as an operating-time first parameter, set on the basis of the condensation pressure of the condenser and the evaporation pressure of the evaporator during operation; may be provided with a first parameter, defined as a branch first parameter, for differentiating between a slave-mode priority region in which the efficiency of the turbo compressor is better in the slave mode than in the independent mode and an independent-mode priority region in which the efficiency of the turbo compressor is better in the independent mode than in the slave mode; and may switch between the slave mode and the independent mode by comparing the operating-time first parameter and the branch first parameter.

The inventors have discovered that it is possible to differentiate between the slave-mode priority region in which the efficiency of the turbo compressor is better in the slave mode than in the independent mode and the independent-mode priority region in which the efficiency of the turbo compressor is better in the independent mode than in the slave mode by using the first parameter set on the basis of the condensation pressure and the evaporation pressure. Thus, the control unit switches between each mode by calculating the first parameter set on the basis of the condensation pressure and the evaporation pressure during operation, to obtain the operating-time first parameter, and by comparing this operating-time first parameter with the branch first parameter. Because the first parameter is a parameter obtained from the condensation pressure and the evaporation pressure, which can be accurately measured using pressure sensors, it is possible to perform control with superior precision. In particular, when a pressure parameter is used as the first parameter, because the pressure parameter is determined by the condensation pressure, the evaporation pressure, and the saturated gas acoustic velocity of the intake refrigerant, it can be determined with even greater precision.

In the case of a turbo chiller equipped with an intermediate cooler, an intermediate pressure, which is the pressure in the intermediate cooler, may also be used.

Furthermore, with the turbo chiller of the present invention, the control unit may be provided with a pressure parameter, defined as a 100% degree-of-opening surge pressure parameter, at which surging occurs at 100% degrees of opening of the first inlet guide vanes and the second inlet guide vanes, for each rotational speed of the turbo compressor, and the first parameter may be set to a value obtained by dividing the pressure parameter at a prescribed rotational speed of the turbo chiller by the 100% degree-of-opening surge pressure parameter corresponding to the prescribed rotational speed.

Because the surge pressure parameter at the time of 100% degrees of opening of the first inlet guide vanes and the second inlet guide vanes is used, the surge pressure parameter is uniquely determined, and a reference becomes more distinct than in the case where the surge pressure parameter at the time of other degrees of opening of each inlet guide vanes is used. In addition, because a normalized first-parameter is obtained by dividing the pressure parameter at the prescribed rotational speed by the 100% degree-of-opening pressure parameter corresponding to the prescribed rotational speed, it is possible to use a first parameter that is not dependent on the rotational speed. Therefore, by performing control with this first parameter, control can be performed with the same reference branch first parameter, even when the rotational speed of the turbo compressor is different, thus realizing simple and highly responsive control.

Turning now to a turbo chiller control method of the present invention, in a method of controlling a turbo chiller including a turbo compressor, equipped with a first impeller and a second impeller disposed downstream of the first impeller, for compressing a refrigerant in two stages, a condenser for condensing the refrigerant compressed by the turbo compressor, an expansion valve for expanding the refrigerant condensed by the condenser, and an evaporator for evaporating the refrigerant expanded by the expansion valve, first inlet guide vanes and second inlet guide vanes for regulating intake refrigerant flow rates being provided at respective refrigerant intakes of the first impeller and the second impeller of the turbo chiller, and the degrees of opening of the first inlet guide vanes and the second inlet guide vanes being controlled, it is possible to switch between a slave mode in which the second inlet guide vanes are operated so as to be dependent on the first inlet guide vanes and an independent mode in which the degree of opening of the second inlet guide vanes is increased independently of the first inlet guide vanes.

As a result of close examination, in a turbo compressor for two-stage compression equipped with a first impeller and a second impeller, the inventors have discovered the existence of an operating region in which the efficiency is better in a slave mode in which the second inlet guide vanes are operated so as to be dependent on the first inlet guide vanes, compared with an independent mode in which the degree of opening of the second inlet guide vanes is increased independently of the first inlet guide vanes, and on the other hand, the existence of an operating region in which the efficiency is better in the independent mode than in the slave mode. Thus, by selectively using the slave mode and the independent mode with the control unit, it is possible to select the operation with better efficiency over a wide operating range.

In the case of the independent mode, it is preferable to control the degree of opening of the second inlet guide vanes so as to be larger than the degree of opening of the second inlet guide vanes in the slave mode, and further, to increase the degree of opening of the second inlet guide vanes to the extent that the second inlet guide vanes are nullified so as to regulate the refrigerant intake amount with the first impeller alone.

According to the above present invention, by selectively using the slave mode and the independent mode and controlling the degrees of opening of the first inlet guide vanes and the second inlet guide vanes, it is possible to select an operation of the turbo compressor with superior efficiency over a wide operating range. Therefore, it is possible to provide a turbo chiller with high COP that is suited to energy saving, as well as a control method therefor.

EXPLANATION OF REFERENCE SIGNS

Figure 1:
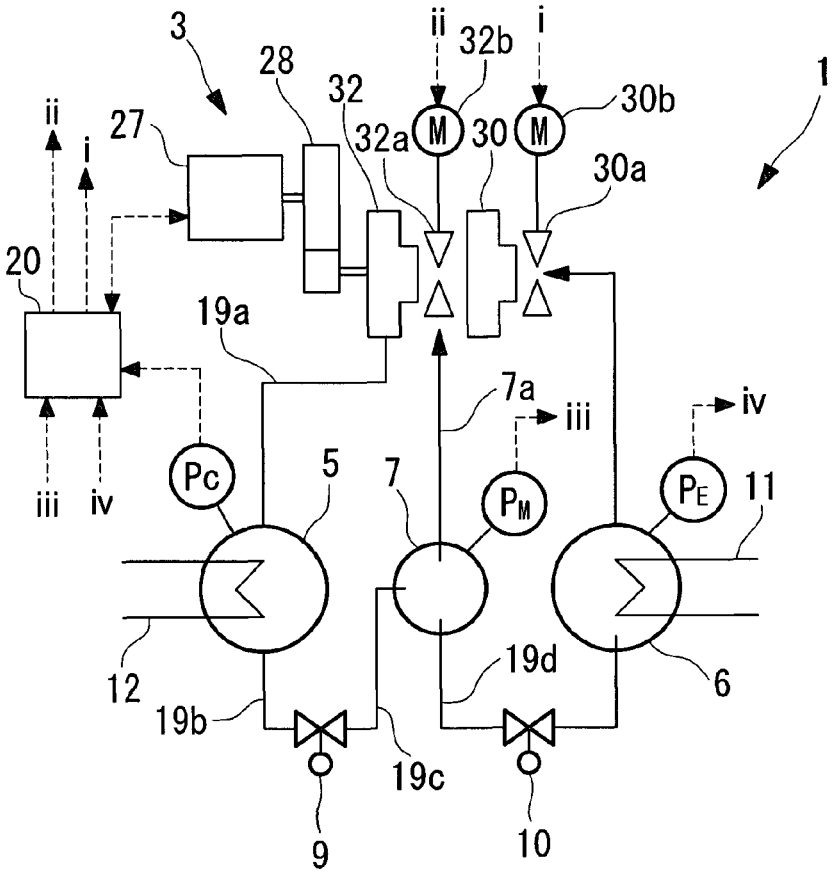
FIG. 1 is a schematic diagram showing the overall configuration of a turbo chiller according to a first embodiment of the present invention.

1: turbo chiller
3: turbo compressor
5: condenser
6: evaporator
20: control unit
30: first impeller
30*a*: first inlet guide vanes
32: second impeller
32*a*: second inlet guide vanes
A: slave-mode priority region
B: independent-mode priority region
Ω: pressure parameter (first parameter)
Ωnow: operating-time pressure parameter (operating-time first parameter)
Ωth: branch pressure parameter (branch first parameter)
Ωsur: 100% degree-of-opening surge pressure parameter
Ωb: control pressure parameter (first parameter)
Ωb_th: branch control pressure parameter (branch first parameter)
Ωb_now: operating-time control pressure parameter (operating-time first parameter)

BEST MODE FOR CARRYING OUT THE INVENTION

First Embodiment

A first embodiment of the present invention will be described below with reference to the drawings.

FIG. 1 shows, in outline, the configuration of a turbo chiller that uses a two-stage compressor. A turbo chiller 1 shown in this figure forms a two-stage compression, two-stage expansion cycle.

The turbo chiller 1 includes a turbo compressor 3 for compressing a refrigerant, a condenser 5 for condensing the refrigerant compressed by the compressor, an evaporator 6 for evaporating the refrigerant, and an intermediate cooler 7 disposed between the condenser 5 and the evaporator 6. A first expansion valve 9 is provided in a refrigerant pipe between the intermediate cooler 7 and the condenser 5, and a second expansion valve 10 is provided in a refrigerant pipe between the intermediate cooler 7 and the evaporator 6.

The turbo compressor 3 is a centrifugal compressor that achieves a high compression ratio.

The turbo compressor 3 includes an electric motor 27, a gear 28, and a first impeller 30 and second impeller 32 provided at the output side of this gear 28.

In some cases, the electric motor 27 is driven by an inverter power supply, and in some cases by system power (50 Hz or 60 Hz). When it is driven by an inverter power supply, frequency control is performed by a control unit 20 of the turbo chiller 1. By doing so, the motor shaft of the electric motor 27 is driven at a desired rotational speed. When it is driven by system power, the rotational speed is constant.

The gear 28, provided between the electric motor 27 and the impellers 30 and 32, increases the rotational speed of the motor shaft of the electric motor 27.

The first impeller 30 and the second impeller 32 are connected in series in the refrigerant flow path; after being compressed by the first impeller 30, the refrigerant is further compressed by the second impeller 32. Gas refrigerant from the intermediate cooler 7 is introduced between (at an intermediate stage) the first impeller 30 and the second impeller 32.

First inlet guide vanes 30*a* for regulating the flow rate of the intake refrigerant are provided at a refrigerant intake of the first impeller 30, and second inlet guide vanes 32*a* for regulating the flow rate of the intake refrigerant are provided at a refrigerant intake of the second impeller 32. The first inlet guide vanes 30*a* and the second inlet guide vanes 32*a* are driven by motors 30*b* and 32*b*, respectively. The motors 30*b* and 32*b* are each controlled by the control unit 20 of the turbo chiller 1. The degree of opening of the first inlet guide vanes 30*a* is controlled so that a coolant outlet temperature after cooling by the evaporator 6 is a desired temperature. The second inlet guide vanes 32*a* are controlled in a dependent manner so as to have the same degree of opening as that of the first inlet guide vanes 30*a* or greater (slave mode), or alternatively, is controlled independently of the degree of opening of the first inlet guide vanes 30*a* so as to have a larger degree of opening than the degree of opening of the second inlet guide vanes in the slave mode (independent mode).

The condenser 5 is, for example, a fin-and-tube type heat exchanger. A coolant pipe 12 is connected to the condenser 5, and heat of condensation is removed by the coolant supplied by this coolant pipe 12. The condenser 5 is provided with a condensation pressure sensor 5*s* for measuring a condensation pressure $P_c$. The output from the condensation pressure sensor 5*s* is sent to the control unit 20.

The evaporator 6 is a shell-and-tube type heat exchanger. A coolant pipe 11 is connected to the evaporator 6, and heat exchange is performed between the coolant flowing in this coolant pipe 11 and the refrigerant inside the shell. The coolant pipe 11 is connected to an external load (not shown in the drawing). When cooling, generally the coolant inlet temperature is set to 12° C., and the coolant outlet temperature is set to 7° C. The evaporator 6 is provided with an evaporation pressure sensor 6*s* for measuring an evaporation pressure $P_E$. The output from the evaporation pressure sensor 6*s* is sent to the control unit 20.

The intermediate cooler 7, which is provided between the condenser 5 and the evaporator 6, has sufficient internal volume, to perform vapor/liquid separation of refrigerant liquid expanded by the first expansion valve 9. The intermediate cooler 7 is provided with an intermediate pressure sensor 7*s* for measuring an intermediate pressure $P_M$. The output from the intermediate pressure sensor 7*s* is sent to the control unit 20.

An intermediate-pressure refrigerant pipe 7*a* that is connected between the first impeller 30 and the second impeller 32 is connected to the intermediate cooler 7. The lower end of the intermediate-pressure refrigerant pipe 7*a* (the upstream end in the flow of refrigerant) is disposed in an upper space inside the intermediate cooler 7 and takes in gas refrigerant inside the intermediate cooler 7.

High-pressure liquid refrigerant from the condenser 5 is evaporated in the intermediate cooler 7, and the liquid refrigerant that is guided to the evaporator 6 is cooled via the intermediate-pressure refrigerant pipe 7*a* by the latent heat of this evaporation. Then, gas refrigerant that is brought close to the saturation temperature via evaporation is mixed with the gas refrigerant compressed from a low pressure to an intermediate pressure by the first impeller 30 to cool the gas refrigerant compressed from an intermediate pressure by the second impeller 32.

The first expansion valve 9, provided between the condenser 5 and the intermediate cooler 7, performs isoenthalpic expansion by throttling the liquid refrigerant.

The second expansion valve 10, provided between the evaporator 6 and the intermediate cooler 7, performs isoenthalpic expansion by throttling the liquid refrigerant.

The degrees of opening of the first expansion valve 9 and the second expansion valve 10 are both controlled by the control unit 20 of the turbo chiller 1.

The control unit 20 is provided on a control board in a control panel of the turbo chiller 1, and is equipped with a CPU and a memory. The control unit 20 calculates various control levels by carrying out digital computations in each control period on the basis of the outside air temperature, the refrigerant pressure, the coolant outlet and inlet temperatures, and so on.

The control unit 20 also controls the degree of opening of the first inlet guide vanes 30*a* of the turbo compressor 3 on the basis of the calculated levels so that the coolant outlet temperature reaches a preset temperature. Additionally, the control unit 20 controls the degree of opening of the second inlet guide vanes according to the slave mode and the independent mode, described later.

The operation of the turbo chiller 1 described above will be explained next.

The turbo compressor 3 is driven by the electric motor 27 and is made to rotate at a prescribed frequency via inverter control by means of the control unit 20. The degree of opening of the first inlet guide vanes 30*a* is adjusted by the control unit 20 so as to achieve a preset temperature (for example, a coolant outlet temperature of 7° C.). The second inlet guide vanes 32*a*, for which the slave mode or the independent mode described later is selected by the control unit 20, are set to a degree of opening according to each mode.

Figure 2:
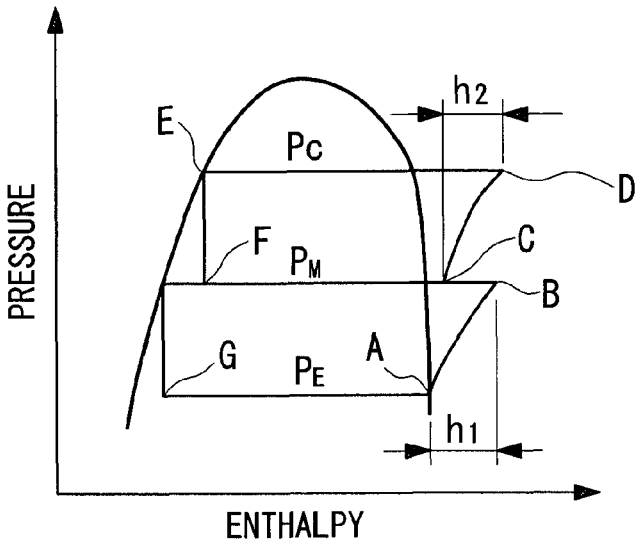
FIG. 2 is a pressure-enthalpy graph showing the refrigerant cycle of the turbo compressor in FIG. 1.

Low-pressure gas refrigerant taken in from the evaporator 6 (state A in FIG. 2) is compressed by the turbo compressor 3 and is compressed to an intermediate pressure (state B in FIG. 2). The gas refrigerant compressed to the intermediate pressure is cooled by the intermediate-pressure gas refrigerant flowing in from the intermediate-pressure refrigerant pipe 7*a* (state C in FIG. 2). The gas refrigerant cooled by the intermediate-pressure gas refrigerant is further compressed by the turbo compressor 3 to form high-pressure gas refrigerant (state D in FIG. 2).

The high-pressure gas refrigerant discharged from the turbo compressor 3 is guided to the condenser 5 via a refrigerant pipe 19*a*.

In the condenser 5, the high-pressure gas refrigerant is substantially isobarically cooled by coolant supplied by the coolant pipe 12 to form high-pressure liquid refrigerant (state E in FIG. 2). The high-pressure liquid refrigerant is guided to the first expansion valve 9 via a refrigerant pipe 19*b* and is isoenthalpically expanded to intermediate pressure by this first expansion valve 9 (state F in FIG. 2). The refrigerant that is expanded to intermediate pressure is guided to the intermediate cooler 7 via a refrigerant pipe 19*c*. In the intermediate cooler 7, some of the refrigerant is evaporated (from state F to state C in FIG. 2) and is guided to an intermediate stage of the turbo compressor 3 via the intermediate-pressure refrigerant pipe 7*a*. The liquid refrigerant that remains condensed without being evaporated in the intermediate cooler 7 is reserved in the intermediate cooler 7. The intermediate-pressure liquid refrigerant reserved in the intermediate cooler 7 is guided to the second expansion valve 10 via a refrigerant pipe 19*d*. The intermediate-pressure liquid refrigerant is isoenthalpically expanded to a low pressure by the second expansion valve 10 (state G in FIG. 2).

The refrigerant expanded to a low pressure is evaporated in the evaporator 6 (from state G to state A in FIG. 2) and removes heat from the coolant flowing in the coolant pipe 11. Accordingly, the coolant flowing in at 12° C. is returned to the external load at 7° C.

The low-pressure gas refrigerant evaporated in the evaporator 6 is guided to a low-pressure stage of the turbo compressor 3 and is recompressed.

Next, the method of controlling the first inlet guide vanes 30*a* and the second inlet guide vanes 32*a* will be described. The control unit 20 of the turbo chiller 1 selects the slave mode or the independent mode according to the operating status of the turbo compressor 3, and degrees of opening according to each mode are applied to each of the inlet guide vanes 30*a* and 32*a*. In the slave mode, the degree of opening of the second inlet guide vanes 32*a* is set so as to depend on the degree of opening of the first inlet guide vanes 30*a*. For example, the degree of opening of the second inlet guide vanes 32*a* is set so as to be the same as the degree of opening of the first inlet guide vanes 30*a*. Alternatively, the degree of opening of the second inlet guide vanes 32*a* is set so as to establish a proportionality relation with the degree of opening of the first inlet guide vanes 30*a*. However, if the degree of opening of the second inlet guide vanes 32*a* is smaller than the degree of opening of the first inlet guide vanes 30*a*, the turbo chiller operates unstably; therefore, the degree of opening of the second inlet guide vanes 32*a* is set to be the same as the degree of opening of the first inlet guide vanes 30*a* or greater.

Basically, in the region where the degree of opening of the inlet guide vanes is large (for example, a degree of opening of 70% or greater), the resolution with respect to the airflow (corresponding to the performance of the turbo compressor) is higher for the slave mode; therefore, the slave mode is selected as the basic operating mode. Then, in an operating region where the efficiency of the turbo compressor is higher in the independent mode than in the slave mode, the independent mode is selected, and the degree of opening of the second inlet guide vanes 32*a* is controlled so as to be larger than the degree of opening in the slave mode.

Figure 3:
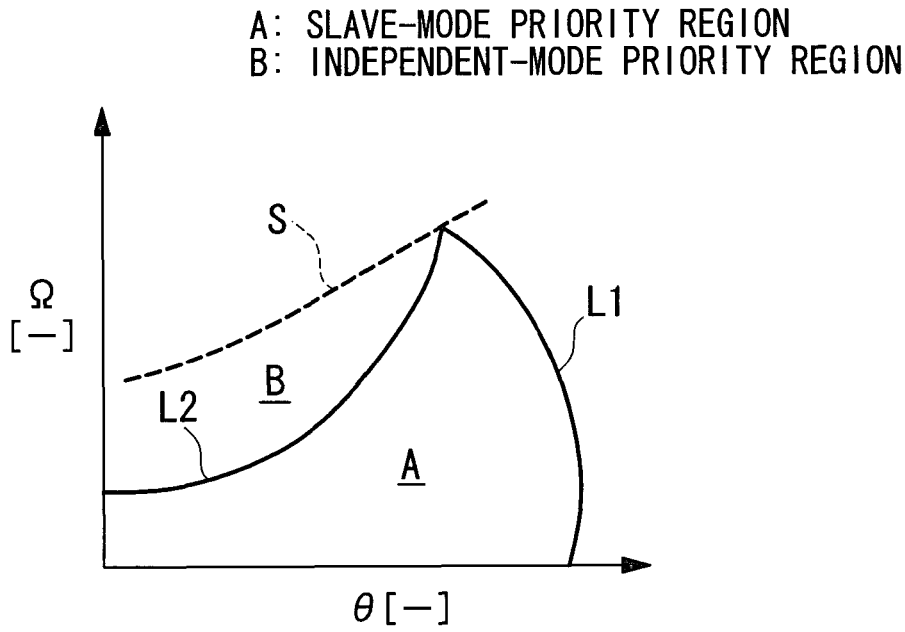
FIG. 3 is a graph of flow rate parameter θ vs. pressure parameter Ω, showing branch lines in which the efficiency of the turbo compressor is inverted in the slave mode or the independent mode.

FIG. 3 shows one way of switching between the slave mode and the independent mode.

In this figure, the horizontal axis represents a flow rate parameter θ (a dimensionless number), and the vertical axis represents a pressure parameter Ω (a dimensionless number).

The flow rate parameter θ is given by $$\theta = Q/(a*D^2) \tag{1}$$

Here, Q is the airflow ($m^3/s$), a is the saturated gas acoustic velocity of the intake refrigerant (m/s), and D is the diameter (m) of the impellers 30 and 32.

The pressure parameter (first parameter) Ω is given by $$\Omega = (h1+h2)*g/(a^2) \tag{2}$$

Here, h1 is the enthalpy drop at the first impeller 30 (see FIG. 2), h2 is the enthalpy drop at the second impeller 32 (see FIG. 2), and g is gravitational acceleration. The enthalpy drops h1 and h2 can be obtained, via isoentropic compression, from the evaporation pressure $P_E$, the intermediate pressure $P_M$, and the condensation pressure $P_C$, as is understood from FIG. 2.

The broken line shown in FIG. 3 is a surge interface line S at which surging occurs. L1 is an operating curve when the degrees of opening of the first inlet guide vanes 30*a* and the second inlet guide vanes 32*a* are both 100%. As shown in FIG. 3, it is found that, below a certain rotational speed, when the efficiency of the turbo compressor in the slave mode and the efficiency in the independent mode are measured to determine which mode has better efficiency, in a region below the branch line L2, that is, a region where the pressure parameter is below and the flow rate parameter is above the branch line L2, the efficiency in the slave mode is higher than in the independent mode, and in a region above the branch line L2, that is, a region where the pressure parameter is higher and the flow rate parameter is lower than the branch line L2, the efficiency in the independent mode is higher than in the slave mode. Accordingly, the degrees of opening of the inlet guide vanes 30*a* and 32 are controlled with the region below the branch line L2 defined as a slave-mode priority region A and the region above the branch line L2 defined as an independent-mode priority region B.

Next, a method of determining the specific degrees of opening of the inlet guide vanes 30*a* and 32*a* will be described.

Figure 4:
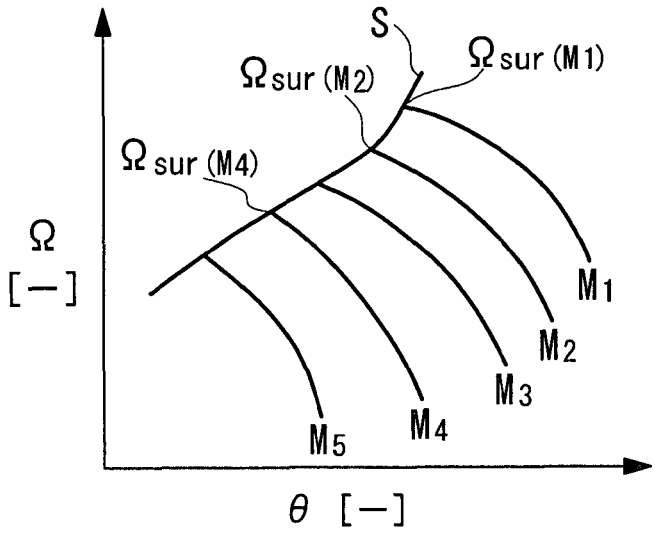
FIG. 4 is a graph of flow rate parameter θ vs. pressure parameter Ω, showing operating curves of the turbo compressor for each Mach number.
Figure 5:
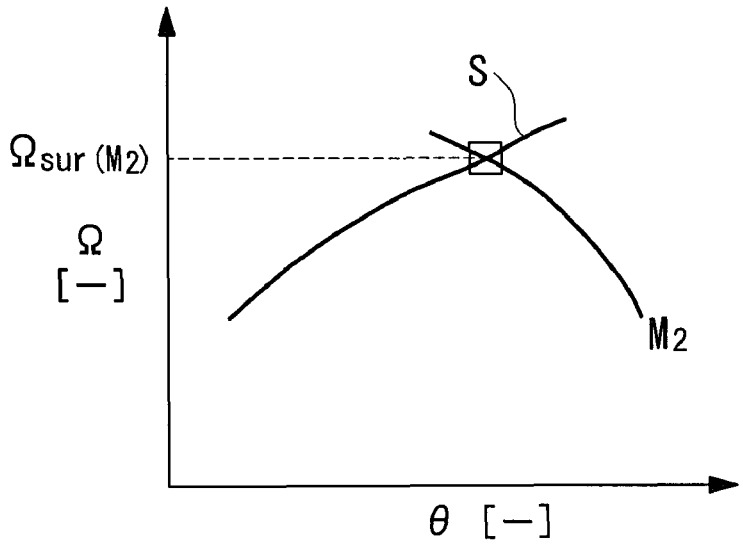
FIG. 5 is a graph of flow rate parameter θ vs. pressure parameter Ω, showing a surge pressure parameter Ωsur(M2) at Mach number M2.
Figure 6:
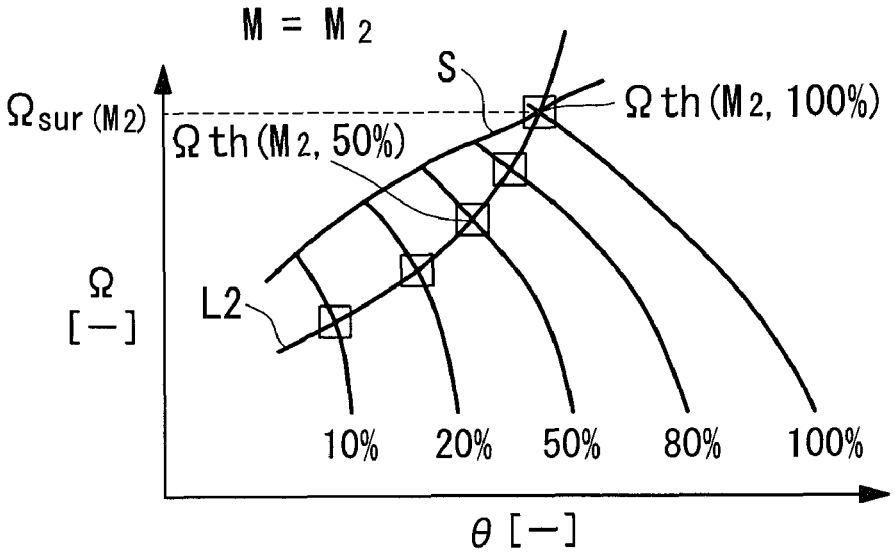
FIG. 6 is a graph of flow rate parameter θ vs. pressure parameter Ω, showing intersections with a branch line L2 for each degree of opening of first inlet guide vanes at Mach number M2.

As shown in FIG. 4, as a characteristic of the turbo compressor 3, the operating curves for Mach numbers M1, M2, . . . of the intake refrigerant are different. FIG. 4 shows the case where the degrees of opening of both inlet guide vanes 30*a* and 32*a* are 100%. As shown in FIG. 5, focusing on a certain Mach number (Mach number M2 in FIG. 5), a graph of flow rate parameter θ vs. pressure parameter Ω is constructed. Then, as shown in FIG. 6, a graph of Ω vs. θ at a certain Mach number (Mach number M2 in FIG. 6) is constructed. On this Ω vs. θ graph, operating curves for each degree of opening of the first inlet guide vanes 30*a* in the slave mode are drawn, and the branch line L2 described using FIG. 3 is also drawn. Then, at each degree of opening IGV1 of the first inlet guide vanes 30*a*, a branch pressure parameter Ωth is obtained from the intersection with the branch line L2. These branch pressure parameters Ωth are sorted for each degree of opening of the first inlet guide vanes 30*a*, with respect to each Mach number (the rotational speed of the turbo compressor 3) M, and are parameters that depend on the Mach number M and the degree of opening IGV1 of the first inlet guide vanes. These branch pressure parameters Ωth(M,IGV1) are obtained in advance by experiment etc. and are stored in a memory in the control unit 20 of the turbo chiller 1.

Figure 7:
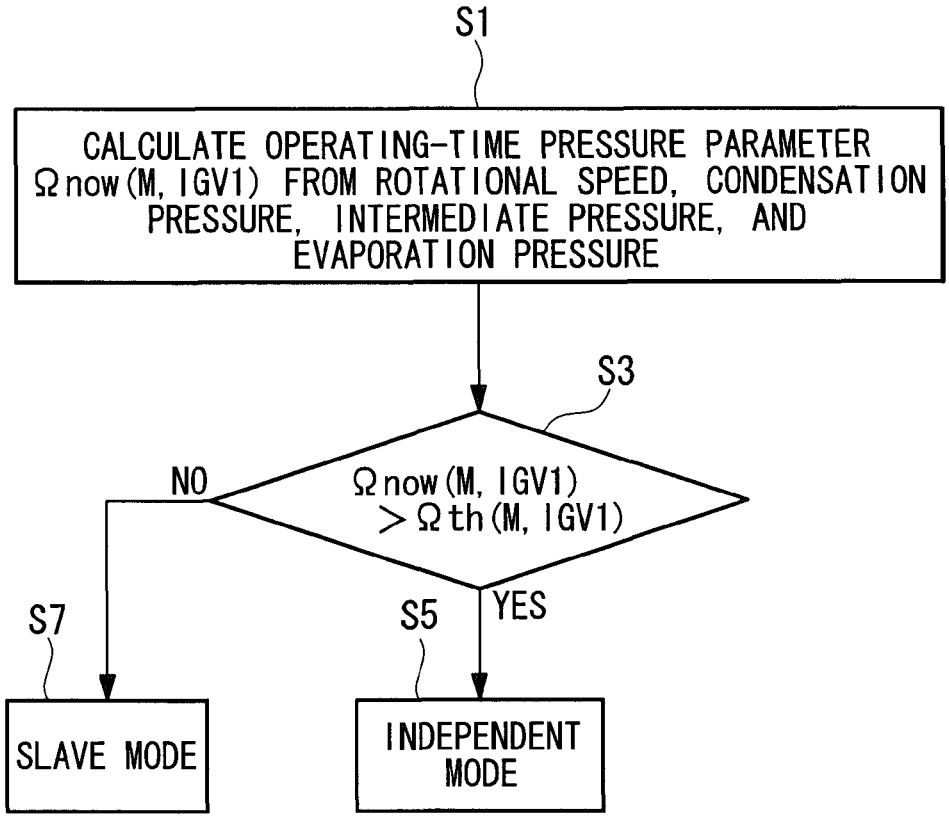
FIG. 7 is a flowchart showing a method of controlling the degree of opening of the first inlet guide vanes and the degree of opening of second inlet guide vanes on the basis of the pressure parameter.

As shown in FIG. 7, during operation of the turbo chiller 1, the control unit 20 calculates an operating-time pressure parameter Ωnow(M,IGV1) at the current degree of opening IGV1 of the first inlet guide vanes from the Mach number M, which is obtained from the rotational speed of the turbo compressor 3, the condensation pressure $P_C$, the intermediate pressure $P_M$, and the evaporation pressure $P_E$, on the basis of equation (2) (Step 51).

Then, proceeding to Step S3, when this operating-time pressure parameter Ωnow(M,IGV1) exceeds the branch pressure parameter Ωth(M,IGV1) at the same Mach number M and the same degree of opening IGV1 of the first inlet guide vanes (YES at Step S3), the process proceeds to step S5, where the independent mode is selected and the degree of opening of the second inlet guide vanes 32*a* is increased. Accordingly, operation in the independent-mode priority region B shown in FIG. 3 is realized. The degree of opening of the second vane 32*a* is controlled so as to be larger than the degree of opening in the slave mode; for example, it may be controlled so as to be fully opened.

In Step S3, if the operating-time pressure parameter Ωnow (M,IGV1) is less than the branch pressure parameter Ωth (NO at Step S3), the process proceeds to Step S7, where the slave mode is selected and, for example, the degree of opening of the second inlet guide vanes 32*a* is set to be the same as the degree of opening of the first inlet guide vanes 30*a*. Accordingly, operation in the slave-mode priority region A shown in FIG. 3 is realized.

By switching between the independent mode and the slave mode in this way, with the branch pressure parameter Ωth(M, IGV1) serving as a threshold, it is possible to select an operation combining the degrees of opening of the inlet guide vanes 30*a* and 32*a* at which the efficiency is always high.

Furthermore, because control can be performed according to the pressure parameter Ω, not by using the flow rate parameter θ, control can be performed simply and with superior precision. The reason is that, for the flow rate parameter θ, the airflow Q must be obtained as shown in equation (1); to obtain the airflow, a flowmeter is required for measuring the flow rate of the coolant, not just the outlet/inlet temperature difference of the coolant cooled by the evaporator 6. In general, turbo chillers are not provided with flowmeters for measuring the coolant flow rate; and even if flowmeters are provided, the precision of flowmeters is not so high. Therefore, because it is necessary either to use an estimated value for the coolant flow rate or to use a coolant flow rate obtained with a comparatively low-precision flowmeter, control using the flow parameter θ has low precision.

The turbo chiller 1 according to this embodiment, described above, affords the following advantages.

By selectively using the slave mode and the independent mode with the control unit 20 of the turbo chiller 1, it is possible to select an operation with superior efficiency of the turbo compressor 3 over a wide operating range. Therefore, it is possible to provide the high-COP turbo chiller 1 which is suited to energy saving.

Switching between each mode is achieved by calculating the pressure parameter during operation, which is determined on the basis of the condensation pressure and the evaporation pressure, to obtain the operating-time pressure parameter Ωnow, and by comparing this operating-time pressure parameter Ωnow with the branch pressure parameter Ωth. Because the pressure parameter is a parameter that is determined from the condensation pressure and the evaporation pressure, which can be measured accurately with pressure sensors, control with superior precision becomes possible. In particular, high-precision control becomes possible because control can be performed without using the flow rate parameter, which is difficult to calculate with high precision.

Second Embodiment

Next, a second embodiment of the present invention will be described. This embodiment differs from the first embodiment only in terms of the method of selecting the slave mode and the independent mode. Therefore, since the other configuration etc. is the same as the first embodiment, a description thereof is omitted.

In this embodiment, it is possible to set the degrees of opening of both inlet guide vanes 30*a* and 32*a* in a simple fashion, independently of the rotational speed of the turbo compressor 3.

As shown in FIG. 4, as a characteristic of the turbo compressor 3, the operating curves for Mach numbers M1, M2, . . . of the intake refrigerant are different. Therefore, the point (θ,Ω) at which surging occurs is different for each Mach number. Considering this further, when the Mach number (the rotational speed of the turbo compressor 3) is determined, a pressure parameter Ωsur at which surging occurs is uniquely determined. The pressure parameter at which surging occurs for 100% degrees of opening of both inlet guide vanes, defined as a 100% degree-of-opening surge pressure parameter Ωsur(M), is determined in advance by experiment etc. for each Mach number M. The 100% degree-of-opening surge pressure parameter Ωsur(M) is stored in a memory in the control unit 20 of the turbo chiller 1.

Then, using the 100% degree-of-opening surge pressure parameter Ωsur(M), the following control pressure parameter Ωb is introduced.

$$\Omega b=\Omega/\Omega sur(M) \tag{3}$$

By normalizing it by dividing by the 100% degree-of-opening surge pressure parameter Ωsur(M) at each uniquely determined Mach number (rotational speed), the control pressure parameter Ωb is a parameter that does not depend on the rotational speed of the turbo compressor 3.

Then, a function for the degree of opening IGV2 of the second inlet guide vanes 32*a* is constructed by using the control pressure parameter (first parameter) Ωb.

$$IGV2=f(\Omega b) \tag{4}$$

For this function, the relationship between Ωb derived from Ω calculated on the basis of the condensation pressure Pc, which falls according to the load on the turbo chiller (for example, derived from the coolant temperature defined in JIS standards) and the optimum IGV2 function is obtained experimentally in advance. In such a case, the effect of the load is eliminated. For example, the function for the degree of opening of the second inlet guide vanes 32*a* is represented by a third-order expression or a second-order expression of the control pressure parameter Ωb.

Figure 8:
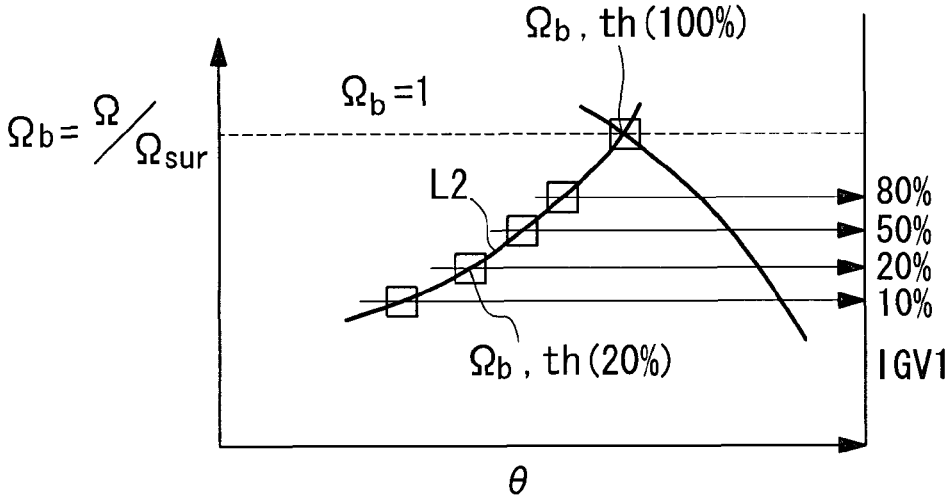
FIG. 8 is a graph of flow rate parameter θ vs. pressure parameter Ω represented using a control pressure parameter Ωb in a second embodiment of the present invention.

When introducing such a control pressure parameter Ωb, as shown in FIG. 8, the branch control pressure parameter Ωb_th (IGV1) that forms a branch point for each degree of opening IGV1 of the first inlet guide vanes when in the slave mode is set to one, independently of the Mach number, in other words, the rotational speed of the turbo compressor 3.

The map shown in FIG. 8 is stored in the memory in the control unit 20 of the turbo chiller 1, and control of the degrees of opening of both inlet guide vanes 30*a* and 32*a* is performed while referring to this map.

Figure 9:
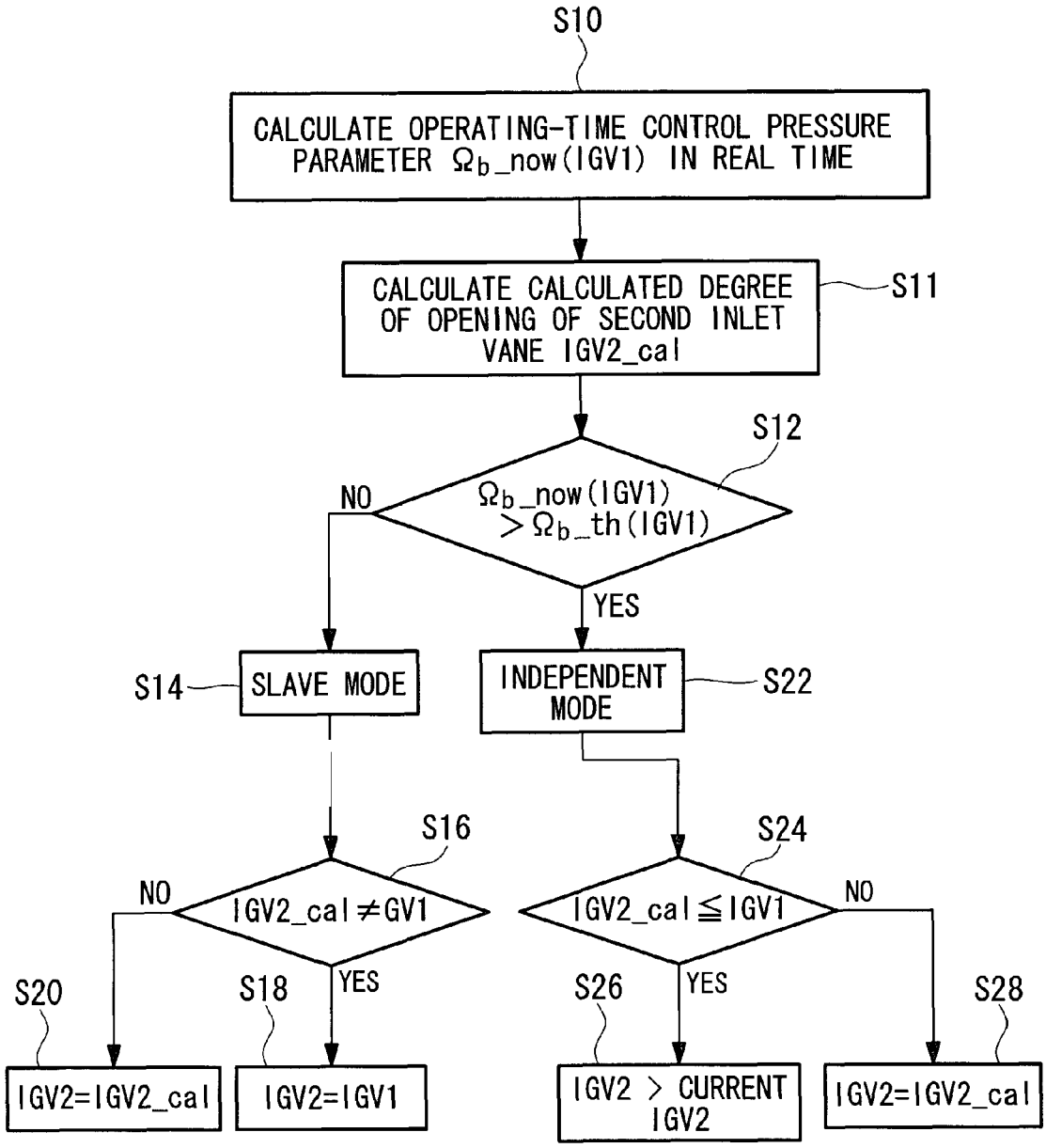
FIG. 9 is a flowchart showing a method of controlling the degree of opening of the first inlet guide vanes and the degree of opening of the second inlet guide vanes on the basis of the control pressure parameter Ωb.

More specifically, control of the degrees of opening of both inlet guide vanes 30*a* and 32*a* is performed as shown in FIG. 9.

During operation, the control unit 20 calculates the operating-time control pressure parameter Ωb_now(IGV1) in real time (step S10). Then, on the basis of this operating-time control pressure parameter Ωb_now(IGV1), it calculates a calculated degree of opening IGV2_cal of the second inlet guide vanes 32*a* from equation (4). At this time, the 100% degree-of-opening surge pressure parameter Ωsur(M) for the Mach number M, which is stored in the memory in the control unit 20, is used.

Then, proceeding to step S12, the operating-time control pressure parameter Ωb_now(IGV1) and the branch control pressure parameter Ωb_th(IGV1) are compared, and if the operating-time control pressure parameter Ωb_now(IGV1) is less than the branch control pressure parameter Ωb_th(IGV1) (NO at step S12), the slave mode is selected (step S14). Then, if the calculated degree of opening IGV2_cal of the second inlet guide vanes 32*a* obtained in step S11 is smaller than or larger than the degree of opening IGV1 of the first inlet guide vanes (YES at step S16), the degree of opening IGV2 of the second inlet guide vanes is controlled so as to be the same as the degree of opening IGV1 of the first inlet guide vanes (step S18).

If the calculated degree of opening IGV2_cal of the second inlet guide vanes 32*a* obtained at step S11 is equal to the degree of opening IGV1 of the first inlet guide vanes (NO at step S16), the calculated degree of opening IGV2_cal is employed as is (step S20).

At step S12, if the operating-time control pressure parameter Ωb_now(IGV1) is greater than the branch control pressure parameter Ωb_th(IGV1) (YES), the independent mode is selected (Step S22). Then, proceeding to Step S24, if the calculated degree of opening IGV2_cal of the second inlet guide vanes 32*a* obtained in step S11 is less than or equal to the degree of opening IGV1 of the first inlet guide vanes (YES at step S24), the degree of opening IGV2 of the second inlet guide vanes is controlled so as to exceed the current degree of opening IGV2 of the second inlet guide vanes, in other words, the degree of opening of the second inlet guide vanes in the slave mode (step S26).

In step S24, if the calculated degree of opening IGV2_cal of the second inlet guide vanes 32*a* obtained in step S11 is larger than the degree of opening IGV1 of the first inlet guide vanes (NO at step S24), the calculated degree of opening IGV2_cal is employed as is (Step S28).

With the turbo chiller 1 according to this embodiment, described above, a control pressure parameter Ωb that is normalized by dividing the pressure parameter Ω at operating time by the 100% degree-of-opening pressure parameter Ωsur corresponding to the same rotational speed is obtained; therefore, it is possible to use a parameter that does not depend on the rotational speed. Accordingly, by performing control with this control pressure parameter Ωb, it is possible to perform control with the same reference branch control pressure parameter Ωb_th even when the rotational speed of the turbo compressor 3 is different, thus realizing simple and highly responsive control.

The invention claimed is:

1. A turbo chiller comprising:

a turbo compressor, equipped with a first impeller and a second impeller disposed downstream of the first impeller, for compressing a refrigerant in two stages;

a condenser for condensing the refrigerant compressed by the turbo compressor;

an expansion valve for expanding the refrigerant condensed by the condenser; and an evaporator for evaporating the refrigerant expanded by the expansion valve, a first inlet guide vane and a second inlet guide vane for regulating intake refrigerant flow rates being provided at respective refrigerant intakes of the first impeller and the second impeller of the turbo chiller;

and comprising a control unit for controlling degrees of opening of the first inlet guide vane and the second inlet guide vane, wherein the control unit is provided with a slave mode in which the second inlet guide vane is operated so as to be dependent on the first inlet guide vane and an independent mode in which the degree of opening of the second inlet guide vane is increased independently of the first inlet guide vane.

2. A turbo chiller according to claim 1, wherein during operation, the control unit calculates a first parameter, defined as an operating-time first parameter, that is set on the basis of a condensation pressure in the condenser and an evaporation pressure in the evaporator, is provided with a first parameter, defined as a branch first parameter, for differentiating between a slave-mode priority region in which the efficiency of the turbo compressor is better in the slave mode than in the independent mode and an independent-mode priority region in which the efficiency of the turbo compressor is better in the independent mode than in the slave mode, and switches between the slave mode and the independent mode by comparing the operating-time first parameter and the branch first parameter.

3. A turbo chiller according to claim 2, wherein the control unit is provided with a pressure parameter, defined as a 100% degree-of-opening surge pressure parameter, for which surging occurs at 100% degrees of opening of the first inlet guide vane and the second inlet guide vane, for each rotational speed of the turbo compressor, and the first parameter takes a value obtained by dividing the pressure parameter at a prescribed rotational speed of the turbo chiller by the 100% degree-of-opening surge pressure parameter corresponding to the prescribed rotational speed.

4. A method of controlling a turbo chiller comprising:

a turbo compressor, equipped with a first impeller and a second impeller disposed downstream of the first impeller, for compressing a refrigerant in two stages, a condenser for condensing the refrigerant compressed by the turbo compressor, an expansion valve for expanding the refrigerant condensed by the condenser, and an evaporator for evaporating the refrigerant expanded by the expansion valve, a first inlet guide vane and a second inlet guide vane for regulating intake refrigerant flow rates being provided at respective refrigerant intakes of the first impeller and the second impeller of the turbo chiller, and the degrees of opening of the first inlet guide vane and the second inlet guide vane being controlled, wherein it is possible to switch between a slave mode in which the second inlet guide vane is operated so as to be dependent on the first inlet guide vane and an independent mode in which the degree of opening of the second inlet guide vane is increased independently of the first inlet guide vane.

* * * * *